US007066098B2

(12) United States Patent
Blasen et al.

(10) Patent No.: US 7,066,098 B2
(45) Date of Patent: Jun. 27, 2006

(54) NESTING TABLE WITH CONTROLLED PIVOTING MOVEMENT

(75) Inventors: Steven T. Blasen, Muscatine, IA (US); Andrew D. Dutton, Edgington, IL (US); Timothy J. Nichols, Nichols, IA (US); Olson R. Ogden, Muscatine, IA (US)

(73) Assignee: HNI Technologies Inc., Muscatine, IA (US)

( * ) Notice: Subject to any disclaimer, the term of this patent is extended or adjusted under 35 U.S.C. 154(b) by 0 days.

(21) Appl. No.: 10/846,294

(22) Filed: May 14, 2004

(65) Prior Publication Data

US 2005/0252426 A1 Nov. 17, 2005

(51) Int. Cl.
*A47B 3/00* (2006.01)

(52) U.S. Cl. ..... 108/115; 108/91

(58) Field of Classification Search ..... 108/115, 108/64, 169, 91, 92, 99, 1, 7, 132, 133; 248/188.6, 248/434, 166, 439, 740
See application file for complete search history.

(56) References Cited

U.S. PATENT DOCUMENTS

| | | | | |
|---|---|---|---|---|
| 2,843,226 | A | 7/1958 | Nordmark | |
| 3,425,365 | A | 2/1969 | Thoreson | |
| 3,796,169 | A | 3/1974 | Bales et al. | |
| 3,903,812 | A | 9/1975 | Cowley | |
| 4,097,941 | A | 7/1978 | Merkel | |
| 4,180,002 | A | 12/1979 | Huempfner | |
| 4,383,486 | A | 5/1983 | Reineman et al. | |
| 4,688,852 | A | 8/1987 | Arai et al. | |
| 4,955,294 | A | 9/1990 | Abe | |
| 5,410,971 | A | 5/1995 | Golden et al. | |
| 5,685,231 | A | 11/1997 | Eyre | |
| 5,778,799 | A | 7/1998 | Eyre | |
| 5,927,214 | A | 7/1999 | Schwartz et al. | |
| 6,006,680 | A * | 12/1999 | Quam et al. | 108/179 |
| 6,257,153 | B1 * | 7/2001 | Portugal | 108/115 |
| 6,336,414 | B1 | 1/2002 | Stewart et al. | |
| 6,662,731 | B1 | 12/2003 | Teppo et al. | |
| 6,672,575 | B1 | 1/2004 | Flower et al. | |
| 6,736,076 | B1 * | 5/2004 | Kaltenmark et al. | 108/132 |
| 6,786,162 | B1 * | 9/2004 | Volkmer et al. | 108/115 |
| 6,845,723 | B1 * | 1/2005 | Kottman et al. | 108/132 |
| 2003/0090137 | A1 | 5/2003 | Piretti | |

* cited by examiner

*Primary Examiner*—Jose V. Chen
(74) *Attorney, Agent, or Firm*—Faegre & Benson, LLP

(57) ABSTRACT

A nesting table comprises a frame, a table top that rotates between a use configuration and a storage configuration, and a control that controls the rate of rotation from the use configuration to the storage configuration but does not affect the rate of rotation of the table top from the storage configuration to the use configuration. An impact protection device can be mounted on the frame to protect an adjacent table when two or more tables are nested in storage configuration. The nesting table also can be provided with a modesty screen that is mounted such that it does not interfere with the rotation of the table top in either direction. The table further can be provided with a latch including a hook, and a hook cover to further protect adjacent tables in nested configuration.

16 Claims, 16 Drawing Sheets

180
184
31
35
70
71
186
230
202
206
232
16'
20'

NESTING TABLE WITH CONTROLLED PIVOTING MOVEMENT

BACKGROUND OF THE INVENTION

This invention relates to a nesting table having a pivoting table top that pivots between a use configuration and a storage configuration. More particularly, this invention relates to a nesting table having a pivoting table top, including means for controlling the rate of rotation of said pivoting table top. In another aspect, this invention relates to nesting tables that nest together in their storage configuration, and to means for preventing damage to such nested tables in contacting relation with one another.

Modern office arrangements need to be flexible to adapt to varying needs. Office furniture also must be adaptable to varying needs. Nesting tables are one type of adaptable furniture known in the office furniture art that can be useful in many office systems. Such nesting tables of the prior art have table tops that can be rotated from a horizontal use configuration to a vertical storage configuration, while the table base remains in the vertical orientation. Such tables can be placed in the use configuration when needed, and in the storage configuration when they are not needed. Such tables can be changed from the use configuration to the storage configuration, and vice versa, by a single user without lifting the entire table frame. In the storage configuration, the bottom surface of the table top contacts the legs of the table frame. One potential disadvantage of such tables is that if the table top rotates too quickly from the use to the storage configuration, the table top can drop against the frame legs, creating a loud unpleasant banging sound and potentially causing damage to the table top, the frame, or both.

Such tables with rotatable tops have the further advantage that can be stored while the base remains in the vertical orientation. Further, such tables can be designed to nest together while in the upright stored configuration, and can be moved into nested configuration by a single user without having to lift the tables. When so stored, adjacent tables will be in contacting relation with one another. In particular, the frame of one table will contact the work surface of the table immediately behind it. One potential disadvantage of such a nested relationship is that if the tables are pushed too hard against one another, or if there is a rough edge on the frame of one table, the work surface of the adjacent table could become scratched or otherwise damaged.

It is thus one object of the invention to provide a nesting table wherein the table top rotates from a horizontal use configuration to a vertical storage configuration in which it contacts the legs of the table frame, yet wherein the table top will not drop hard against the table frame, such that there will be no loud banging sound, and further such that neither the table top nor the frame will be damaged as the table top moves into contacting relation with the frame.

It is another object of the invention to provide a nesting table wherein the table top rotates from a horizontal use configuration to a vertical storage configuration such that a plurality of tables in a storage configuration can be stored in nesting relation, and in which adjacent nested tables will not be damaged by contact with one another.

SUMMARY OF THE INVENTION

In one aspect of the invention, a nesting table is provided, the nesting table comprising a frame, a table top pivotably mounted to the frame, the table top being able to pivot between a use configuration that is horizontal relative to the frame and a storage configuration that is vertical relative to the frame, and a control means that controls the rate of pivoting of the table top from the use configuration to the storage configuration. In a further embodiment, the control means does not exert any forces against the table top when it is being rotated from the vertical storage configuration to the horizontal use configuration, yet it exerts a counterforce as the table top is being rotated from the horizontal use configuration to the storage configuration. This counterforce slows the rate of rotation, so that the table top comes to rest against the frame, but does not strike the frame so hard as to cause damage to either the frame of the table top. In yet a further embodiment, the control means is a surface effect damper.

In another aspect of the invention, a nesting table is provided, the nesting table comprising a frame, a table top pivotably mounted to the frame, the table top being able to pivot between a use configuration that is horizontal relative to the frame and a storage configuration that is vertical relative to the frame, the frame being further provided with impact protection means, such that adjacent nesting tables will not be damaged by contact with one another. In a preferred embodiment, such impact protection means also can serve to dampen the impact that occurs when a table top is rotated from the vertical configuration to a horizontal use configuration. In a most preferred embodiment, such impact protection means also can serve to close the ends of hollow portions of the table frame that would otherwise be exposed when the table top is in the vertical configuration.

A more complete understanding of the present invention and other objects, advantages and features thereof will be gained from a consideration of the following description of a preferred embodiment read in conjunction with the accompanying drawings provided herein. The preferred embodiments represent examples of the invention which are described here in compliance with Title 35 U.S.C. section 112 (first paragraph). The invention itself is defined by the attached claims.

BRIEF DESCRIPTION OF THE DRAWINGS

The following description of the present invention will be more readily understood by reference to the figures, wherein.

DETAILED DESCRIPTION OF A PREFERRED EMBODIMENT

Figure 1:
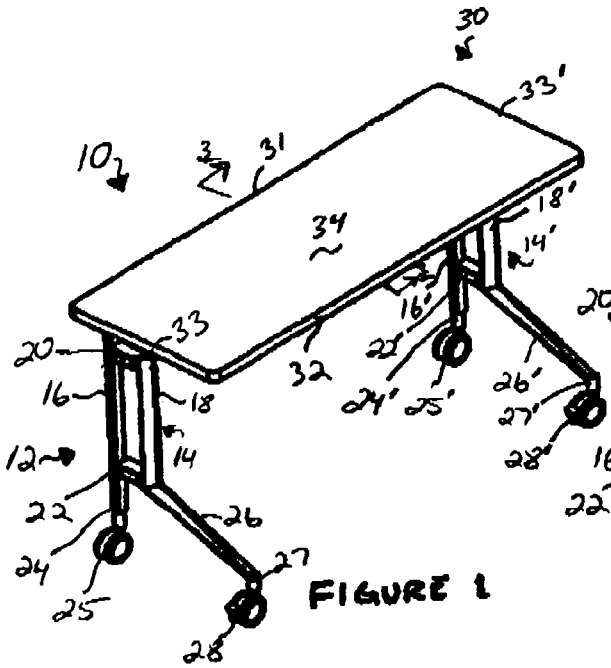
FIG. 1 is a perspective view of a table of the present invention, shown in the horizontal use configuration.

The general construction of a nesting table of the instant invention is illustrated in FIGS. 1–6. As illustrated, a nesting table 10 comprises a frame 12 and a table top 30. The frame 12 comprises two vertical support members, 14, 14,' that are preferably connected by a horizontal support member 15, each vertical support member 14, 14,' comprising a rear leg member 16, 16', and a front leg member 18, 18'. The leg members 16, 18, 16' 18,' in each of the vertical support members 14, 14,' respectively, are connected to one another by one or more rigid brace means; in the illustrated embodiment, vertical support member 14 is provided with two brace means 20, 22, and vertical support member 14' is provided with two brace means 20,' 22,' of which only 22' is visible in FIGS. 1 and 2. The upper ends of front leg members 18, 18' are lower than the upper ends of rear leg members 16, 16', in order to accommodate the pivoting movement of table top 30, as described below.

Figure 15:
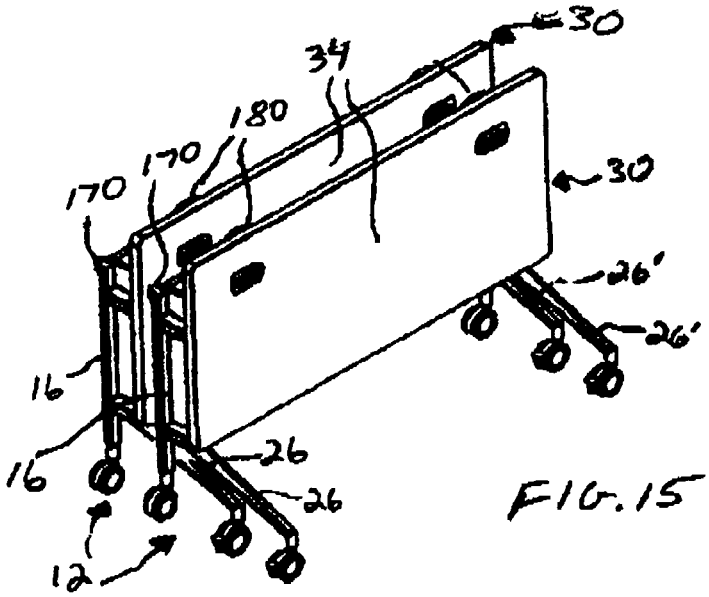
FIG. 15 illustrates two tables in the storage configuration in nested storage.

Rear leg members 16, 16' terminate at their lower ends with foot members 24, 24,' which optionally can be provided with casters 25, 25.' Front leg members 18, 18' terminate at their lower ends with extension members 26, 26,' which are set at an angle to allow a plurality of tables of the present invention to nest together when the tables are in their storage configuration, as illustrated in FIG. 15. Each extension member 26, 26' terminates at its end with a foot member 27, 27,' which optionally can be provided with casters 28, 28.'

Figure 2:
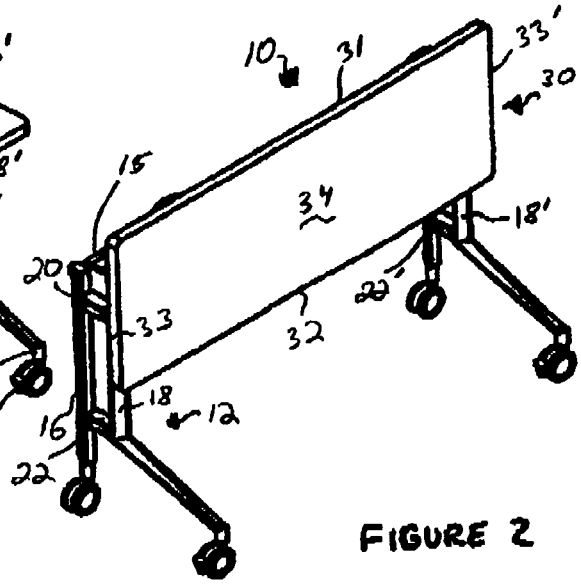
FIG. 2 is a perspective view of a table of the present invention, shown in the vertical storage configuration.
Figure 3:
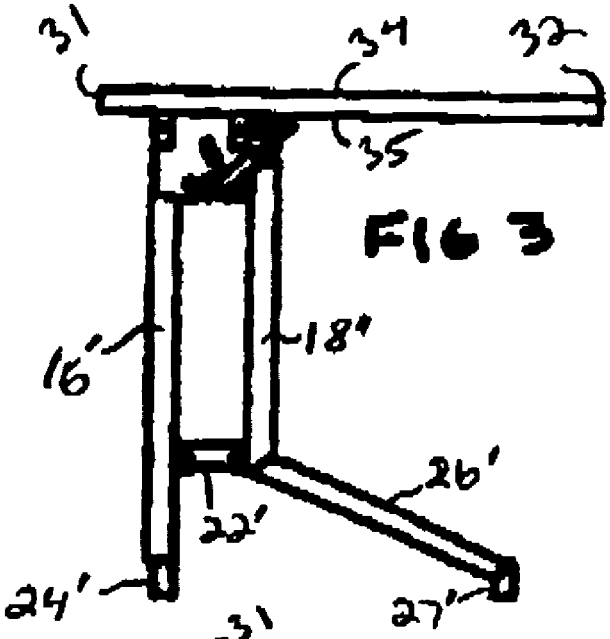
FIG. 3 is a side cross-sectional view of the table as shown in FIG. 1, taken through line 3—3.
Figure 4:
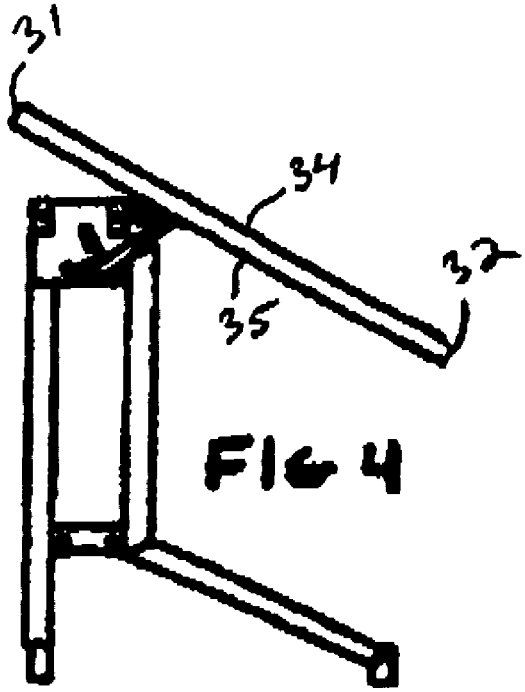
FIG. 4 is a side cross-sectional view of the table showing the top as it begins to pivot from the use configuration to the storage configuration.
Figure 5:
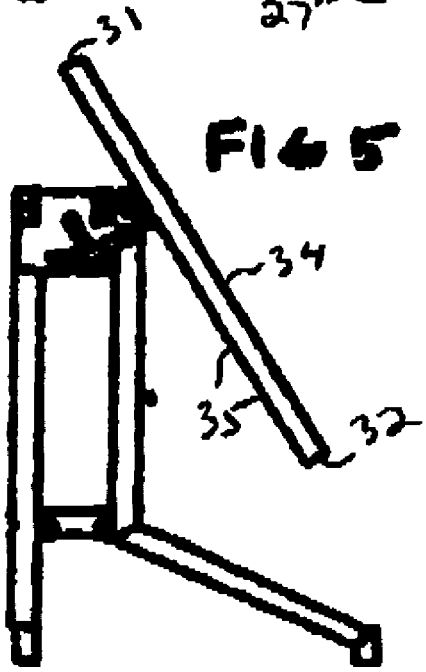
FIG. 5 is a side cross-sectional view of the table showing the top as it approaches the storage configuration.
Figure 6:
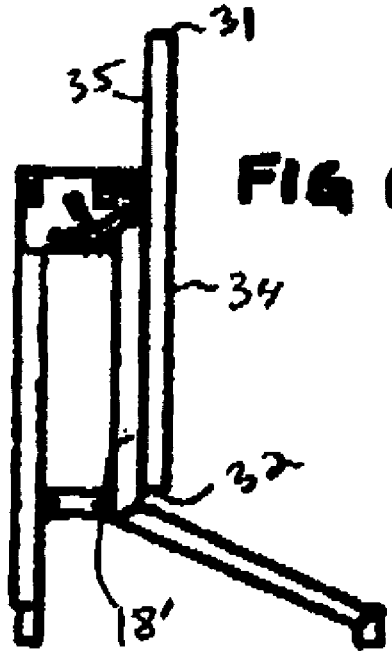
FIG. 6 is a side cross-sectional view of the table as shown in FIG. 2.

Table top 30 has a rear edge 31, a front edge 32, two side edges 33, 33,' a top surface 34, and a bottom surface 35. FIGS. 1 and 3 show the table 10 in the use configuration, with table top 30 oriented horizontally. FIGS. 2 and 6 show the table 10 in the storage configuration, with table top 30 oriented vertically, such that rear edge 31 faces upwardly and front edge 32 faces downwardly. FIGS. 4 and 5 show the stages of motion of the table top 30 as it moves from the use configuration of FIGS. 1 and 3 to the storage configuration of FIGS. 2 and 6. As shown most clearly in FIG. 6, when the table 10 of the invention is in the storage configuration, the bottom surface 35 of table 30 is in contact with front leg members 18, 18' of vertical support members 14, 14.'

When table 10 is in the use configuration, table top 30 is maintained in the horizontal orientation by a latch means, illustrated in FIGS. 19–24 and described in more detail below. When the latch means is released by a user, the table top 30 begins to rotate. Depending on the size and weight of the table top, the rotation can be rapid. If the table top 30 is mounted to the horizontal member 15 of frame 12 at a position that is not centered between back edge 31 and front edge 32, as in the illustrated embodiment, then the placement of the center of gravity of table top 30 away from the horizontal member 15 can result in a very rapid rotation of the table top 30. This rapid rotation can cause the bottom surface 35 of table top 30 to strike the front surfaces of front leg members 18, 18' with great force, causing a loud banging noise that is both unpleasant and disruptive to an office working environment. In some cases, the force of the contact can be great enough to damage either the table top 30, the front leg members 18, 18,' or both.

In accordance with the invention, this situation is addressed by providing a control means 40 operating coupled to table top 30 to control the rate of rotation of the table top 30 as it moves from the use configuration to the storage configuration. Such a control means can be, for example, in the form of a gas piston or a compression spring. Preferably, the control means will be one that does not exert any force against the table top when it is being rotated from the vertical storage configuration to the horizontal use configuration, but will exert a counterforce against the table top when it is being rotated from the horizontal use configuration to the vertical storage configuration. More preferably, the control means 40 is in the form of a damper as illustrated herein. One particularly preferred type of damper is a surface-effect damper of the type sold by Lord Corporation, of Cary, N.C., and described in U.S. Pat. No. 6,672,575, incorporated herein by reference. As described in that patent, such a surface-effect damper generally comprises a chamber and a contact element movable through the chamber in two directions, and at least two damping elements surrounding the contact element in the chamber, each damping element being movable into frictional engagement with the chamber wall during movement of the contact element in one direction, and movable out of frictional engagement with the chamber wall during movement of the contact element in the opposite direction.

In the following description of a preferred embodiment, it will be understood that the control means and mounting means on either side of the table are substantially identical mirror image structures of each other.

Figure 7:
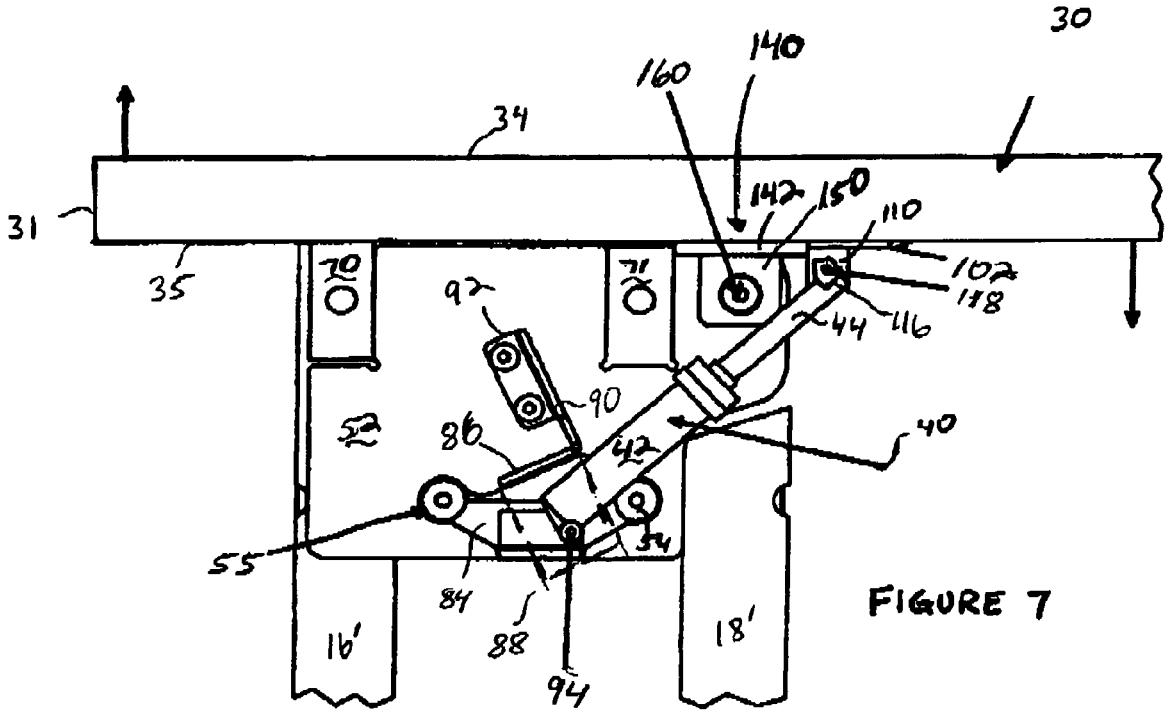
FIG. 7 is an enlarged side view of a portion of the table showing the mounting of an embodiment of the control means to the table frame.
Figure 8:
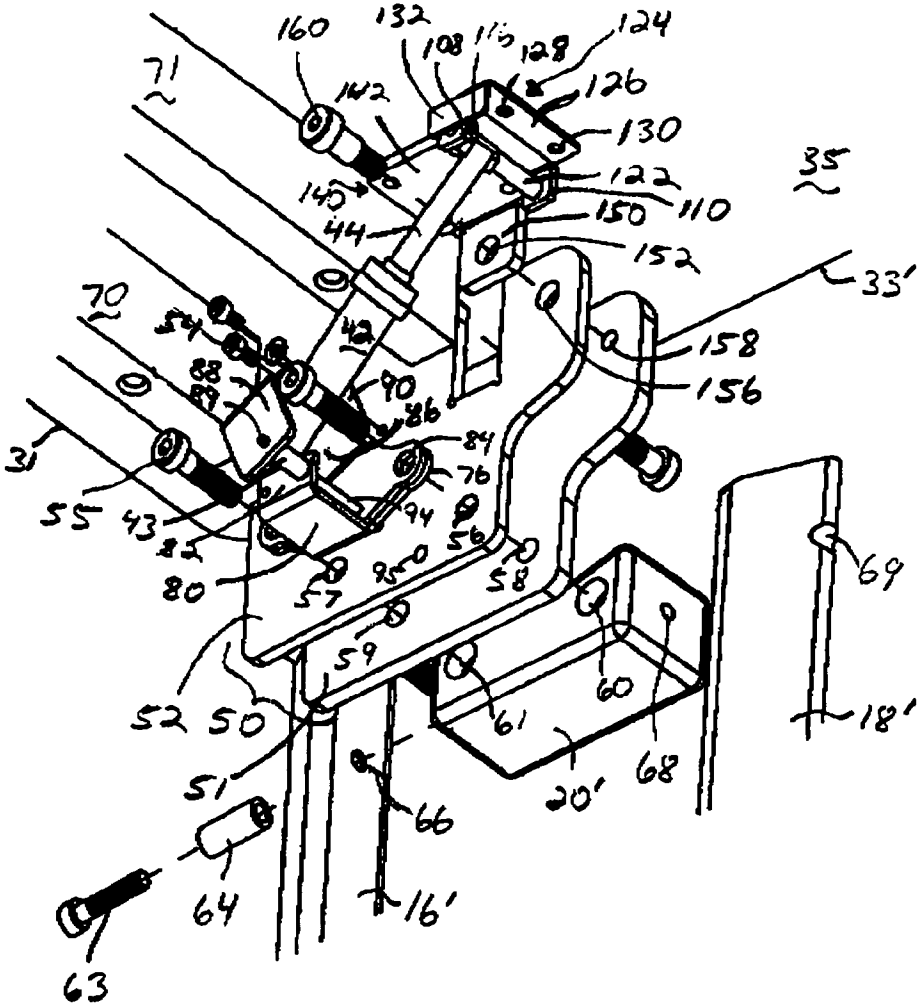
FIG. 8 is an exploded perspective view of the mounting of the control means to the right-hand side of the table frame, viewed from beneath the table top.
Figure 9:
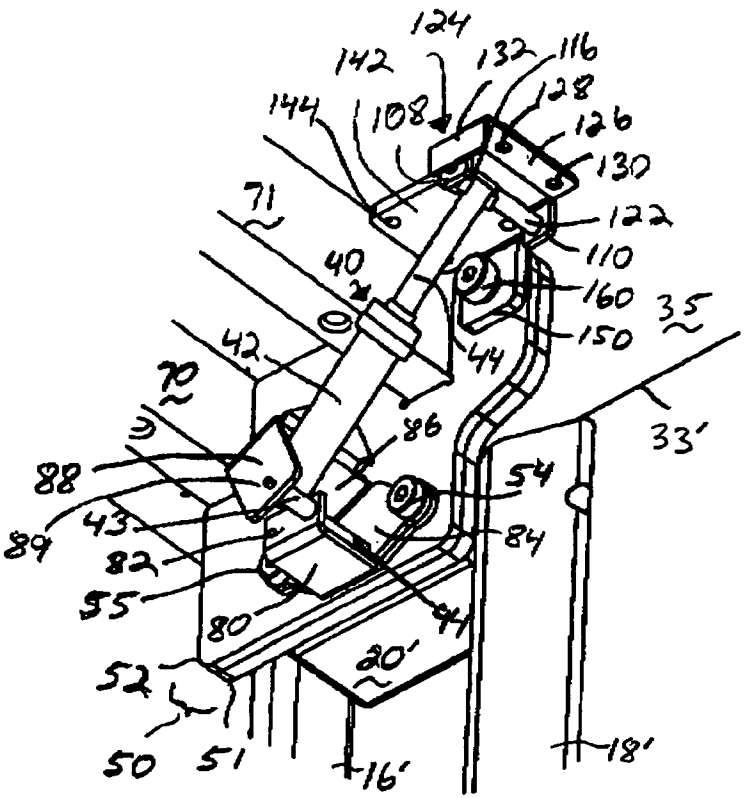
FIG. 9 is an assembled view of FIG. 8.
Figure 11:
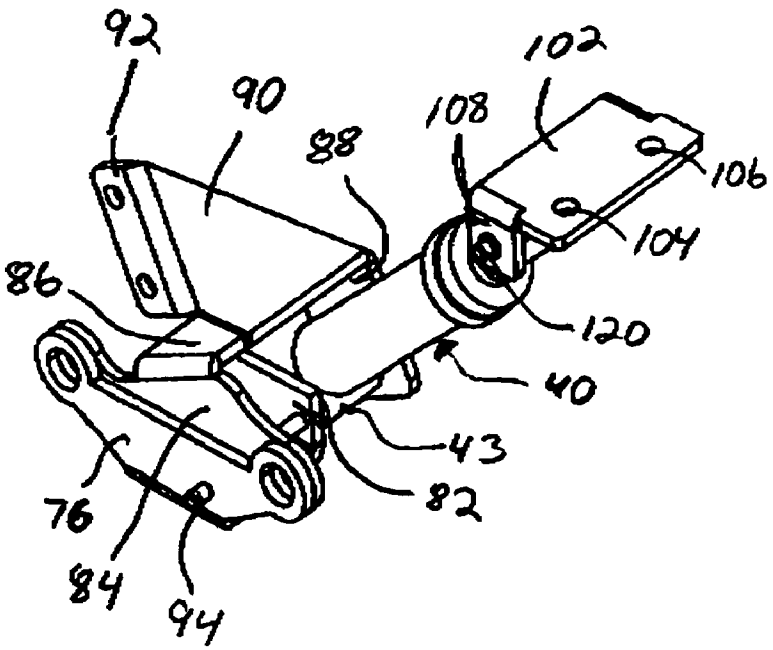
FIG. 11 is an assembled view of FIG. 10.
Figure 10:
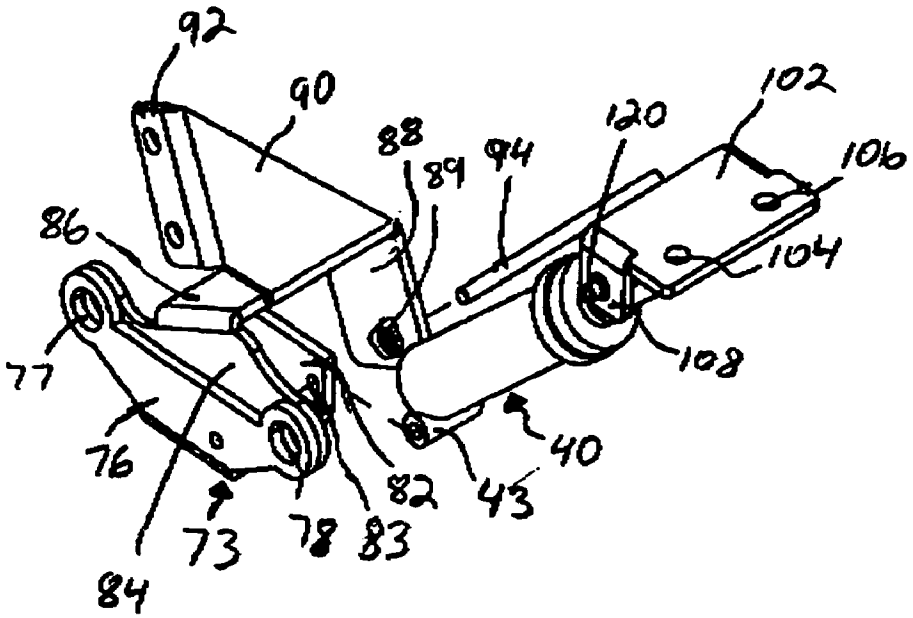
FIG. 10 is an exploded view of the means for securing the lower end of the control means to the left-hand side of the table frame.

Referring now to FIGS. 7–9, control means 40 is shown as a surface effect damper having a housing 42 that surrounds a chamber, not shown, and a contact element 44 movable in and out of the chamber in housing 42, such that one end of contact element 44 is always contained within the chamber. Disposed within the chamber are at least two damping elements, also not shown, that surround contact element 44, and that move in and out of contact with the chamber walls as the contact element moves in and out of the chamber. When table top 30 is rotated into its horizontal use configuration, contact element 44 is pulled out of the chamber within housing 42, and the at least two damping elements move out of contact with the chamber walls, such that control means 40 offers no resistance against the rotating movement of table top 30. When table top 30 is rotated from the horizontal use configuration into the vertical storage configuration, contact element 44 is pushed back into the chamber within housing 42, and the damping elements are urged into frictional engagement with the chamber walls, such that the control means 40 applies a resistive counterforce against the downward rotational movement of table top 30. This counterforce prevents bottom surface 35 of table top 30 from striking the front of front leg members 18, 18' with any undue force that might cause damage to either component of table 10.

One embodiment of means for mounting control means 40 to table 10 is illustrated in FIGS. 7–13. Such mounting means can comprise a dual member mounting plate 50 comprising first mounting plate 51 disposed directly against the frame 12 and second mounting plate 52 disposed against first mounting plate 51. In the illustrated embodiment, first mounting plate 51 is somewhat thicker than second mounting plate 52. Dual member mounting plate 50 is mounted to brace means 20' by bolts 54, 55 that each pass respectively through holes 56, 57 in second mounting plate 52, holes 58, 59 in first mounting plate 51, and holes 60, 61 in brace means 20'. Brace means 20' is mounted to rear leg member 16' by bolt 63 that passes through optional spacer 64, then through hole 66 in rear leg member 16'. Likewise, a similar bolt protrudes through a spacer passing through front leg 18' into threaded hole 68. Alternatively, a single elongated bolt can pass through both rear leg 16', brace means 20', and front leg 18'.

Horizontal support member 15 comprises primary support bar 70, which is connected to each of rear leg members 16, 16' through bolts that extend through the first mounting plates 51 on either end of the table. A secondary support bar 71, disposed above and rearwardly of the upper ends of front leg members 18, 18', also is connected by bolts to the two first mounting plates 51 on either end of the table. Second mounting plate 52 is provided with appropriate notches that fit around the support bars 70, 71. When the table 10 is in the use configuration, the bottom surface 35 of table top 30 rests on top of support bars 70, 71 and is secured by conventional releasable latch means as described below, but is not fixedly attached thereto. Support bar 70 maintains the rear leg members 16, 16' in the vertical configuration, and support bars 70, 71 support table top 30 to prevent it from bowing when subjected to heavy loads.

The control means 40 is mounted to the table frame by means of lower mounting bracket 72 and upper retaining bracket 100. Lower mounting bracket 72 comprises first bracket member 73 and second bracket member 74. First bracket member 73 comprises mounting plate 76 having two holes 78, 77 in alignment with holes 56, 58, 60 and holes 57, 59, 61, respectively. Extending from mounting plate 76 is a support arm 80 with an upwardly extending tab 82 having a hole 83. Mounting plate 76, support arm 80 and upwardly extending tab 82 generally define a "U" shaped structure. Second bracket member 74 comprises mounting plate 84, support arm 86, and downwardly extending tab 88, which together generally define a downwardly directed "U" shaped structure. In FIG. 7, downwardly extending tab 88 is shown in phantom lines so that the axis of rotation of control means 40 can be seen, as explained below. Gusset 90 extends from the forward edge of support arm 86 back to second mounting plate 52 where it terminates in mounting tab 92.

Integral with housing 42 of control means 40 at the base thereof is a mounting collet 43. In the illustrated embodiment, collet 43 is offset from the axis of motion of contact member 44, although collet 43 can be anywhere on housing 42 that is desirable for a particular use. Collet 43 has an axis perpendicular to the axis of movement of contact member 44. Pin 94 extends through hole 89 in downwardly extending tab 88, through collet 43 of control means 40, through hole 83 in upwardly extending tab 82, through holes in mounting plates 84 and 76, and through a hole 95 in mounting plate 52. First bracket member 73 and second bracket member 74 are then mounted to mounting plates 52, 51, by bolts 55, 54, described above, such that bolt 55 extends through corresponding holes in bracket mounting plates 84 and 76 before entering the holes in mounting plates 52, 51, and brace means 20'.

Figure 13:
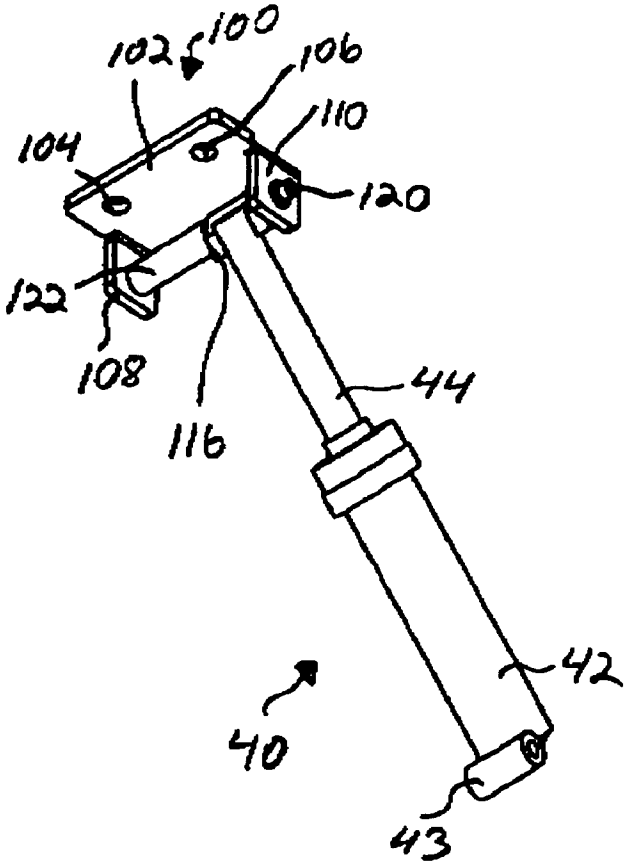
FIG. 13 is an assembled view of FIG. 12.
Figure 12:
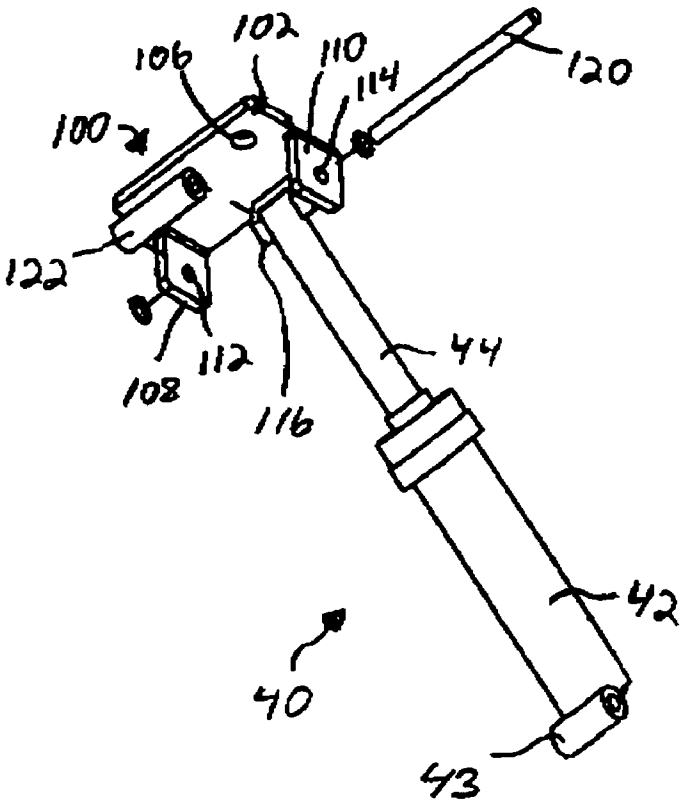
FIG. 12 is an exploded view of the means for securing the upper end of the control means to the left-hand side of the table top.

Referring now to FIGS. 12, 13, the upper end of connecting element 44 is connected to lower surface 35 of tabletop 30 by upper retaining bracket 100. Upper retaining bracket 100 comprises mounting plate 102 having holes 104, 106 therein to allow mounting of the plate 102 to the bottom surface 35 of table top 30, and depending tabs 108, 110, each of which has a hole 112, 114 therein. A yoke member 116 is pivotably mounted to the end of contact element 44. Yoke member 116 includes aligned holes 118. In assembly, a dowel pin 120 passes through hole 114 of depending tab 110, through the holes 118 of yoke member 116 on the end of contact element 44, through optional spacer 122, and through hole 112 of depending tab 108. In this manner, the end of connecting member 44 is rotatively coupled to bottom surface 35 of tabletop 30. A securement bracket 124, illustrated in FIGS. 8, 9, includes a plate member 126 having holes 128, 130 that align with holes 104, 106 on mounting plate 102 of upper retaining bracket 100. A depending tab 132 extends downwardly and rearwardly from one end of plate member 126 to cover depending tab 108 and the exposed end of dowel pin 120. Fasteners such as screws or bolts extend through aligned holes 104, 128 and aligned holes 106, 130 to secure securement bracket 124 and upper retaining bracket 100 to the bottom surface 35 of table top 30.

Table top 30 is mounted to table frame 12 by means of L-shaped mounting bracket 140, comprising mounting plate 142 and depending tab 150. Mounting plate 142 is provided with a plurality of holes 144, by which mounting plate 142 is secured to bottom surface 35 of tabletop 30 by known fastening means such as bolts or screws. Mounting bracket 140 is secured to bottom surface 35 such that hole 152 in depending tab 150 is aligned with hole 156 in mounting plate 52 and hole 158 in mounting plate 51. Bolt 160 passes through holes 152, 156, and 158 to pivotably secure the table top 30 to the table frame 12.

When table top 30 is lowered from the horizontal use configuration to the vertical storage configuration, as shown in FIGS. 3–6, the table top rotates about the axis defined by bolt 160. As the table top 30 begins to rotate downwardly, upper retaining bracket 100 and securement bracket 124 also begin to rotate with it. Contact element 44 of control means 40 is pushed into the chamber within housing 42, and the damping elements within the chamber in housing 42 are pushed into frictional engagement with the chamber walls. This friction results in a counterforce being exerted against the downward rotation of table top 30, which slows its rate of rotation so that bottom surface 35 does not strike the front of front leg members 18, 18' with undue force. When it is desired to return the table top to the horizontal use configuration shown in FIG. 3, it is simply lifted into position. As the contact element 44 is drawn out of the chamber within housing 42, the damping elements within the chamber are pulled out of frictional engagement with the chamber walls. Thus the control means 40 offers no resistance to the upward rotation of the table top 30 to the horizontal use configuration.

Figure 14:
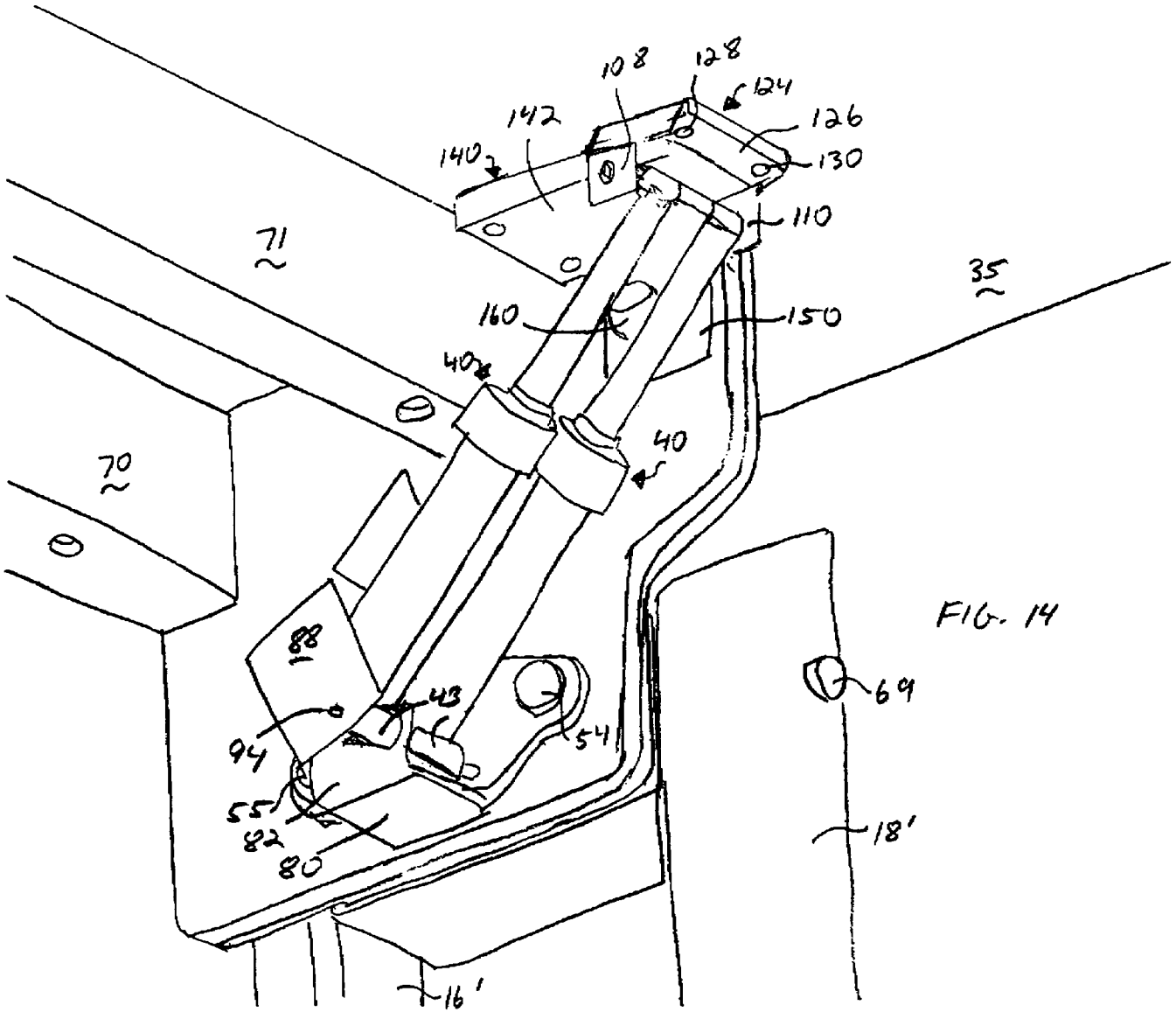
FIG. 14 illustrates an embodiment in which two of the control means are used together on one side of the table.

The table 10 of the present invention has been discussed in terms of having one control means 40 on either side of the table frame. For larger tables it may be desirable to have more than one control means on one or both sides of the table frame. FIG. 14 illustrates an embodiment wherein two control means 40 are installed on one side of a table frame. The collet 43 of the second control means is mounted on pin 94 and is disposed between upwardly extending tab 82 of lower mounting bracket 72 and mounting plate 84 of upper mounting bracket 74. The yoke member 116 of the second control means is mounted on dowel pin 120 in place of spacer 122. Depending on the size and weight of the table top 30, the table 10 can have one control means 40 on each side, one control means 40 on one side and two control means 40 on the other side, or two control means 40 on each side.

In another aspect of the invention, the frame 12 of table 10 is provided with impact protection means, such that adjacent nesting tables will not be damaged by contact with one another. FIG. 15 illustrates two tables of the present invention, each in the storage configuration, and in nesting relationship with one another. It will be seen that the top surface 34 of table top 30 of the rear table is in direct contact with the frame 12 of the table in front of it. In particular, if the rear leg members 16, 16' are tubular structures, then when the table top 30 is in the storage configuration, the open edges of the tubes of rear leg members 16, 16' are exposed. If these open edges contact an adjacent table top surface 34, as shown in FIG. 15, then the table top surface 34 can be scratched or otherwise damaged. The exposed open end of the tubes also can be aesthetically unappealing.

Figure 16:
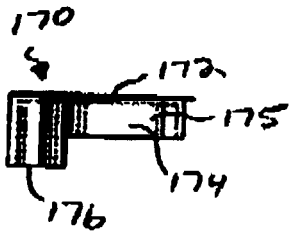
FIG. 16 is a side view of an impact protection means of the present invention.
Figure 17:
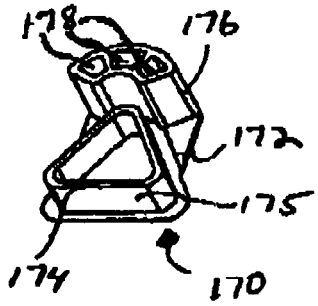
FIG. 17 is bottom perspective view of an impact protection means of the present invention.
Figure 18:
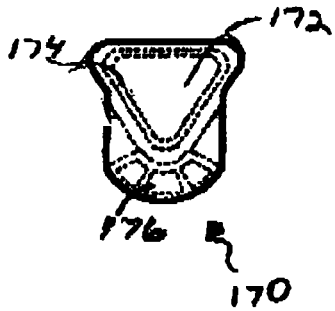
FIG. 18 is a top plan view of an impact protection means of the present invention, with structure beneath shown in phantom lines.
Figure 19:
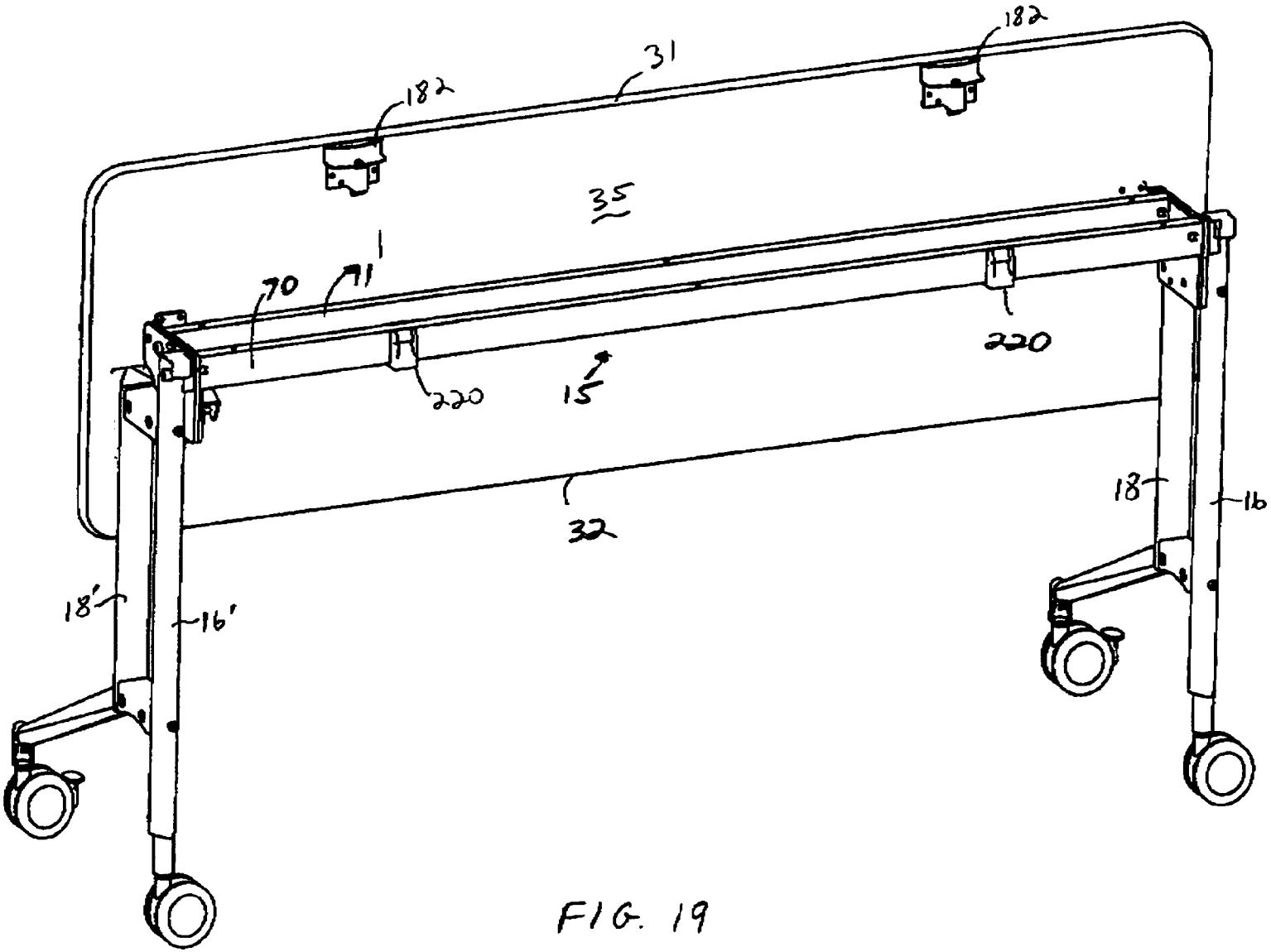
FIG. 19 is a rear view of a table of the invention in storage configuration showing the latch means.
Figure 20:
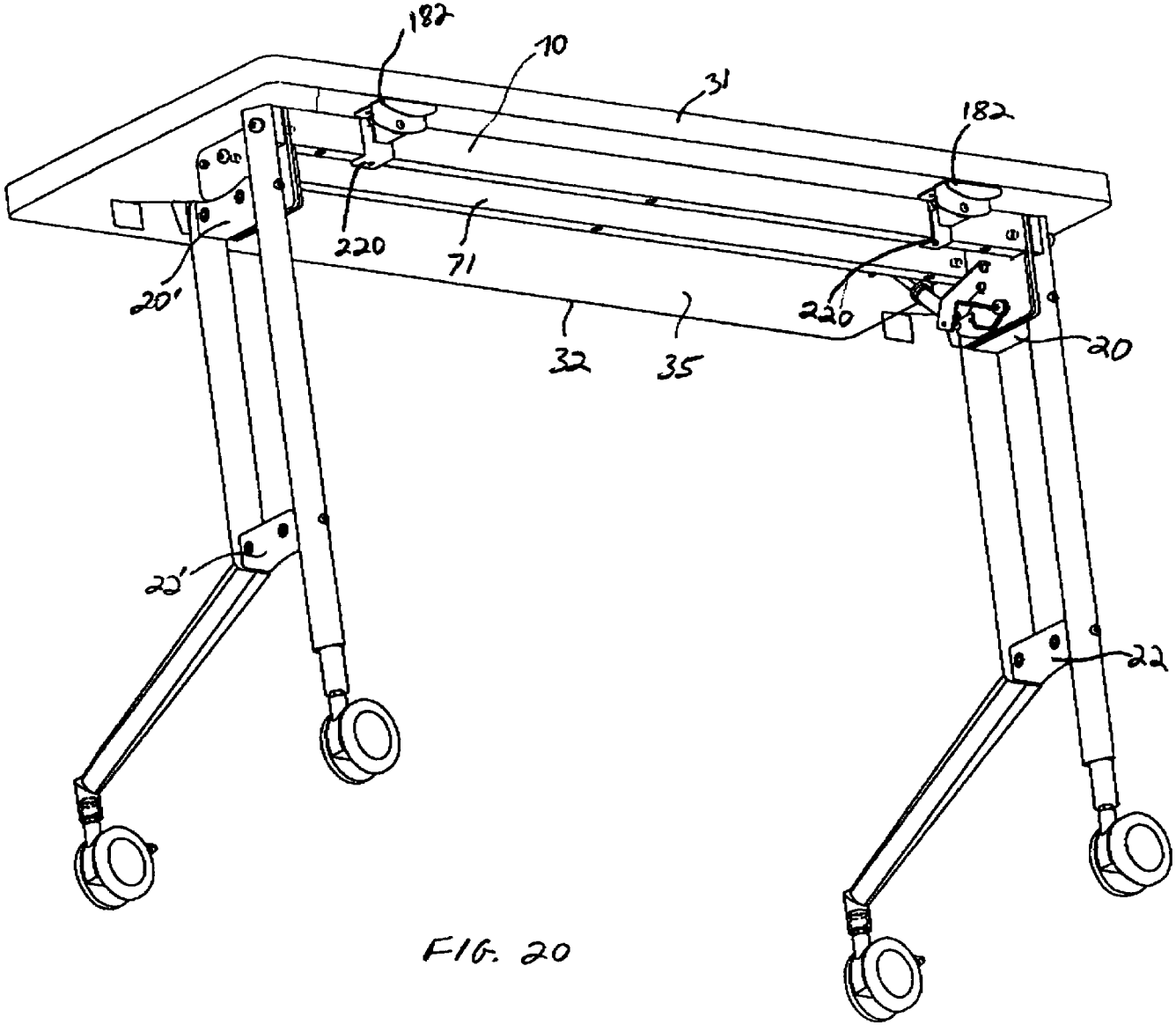
FIG. 20 is a rear view of a table of the invention in use configuration showing the latch means.
Figure 21:
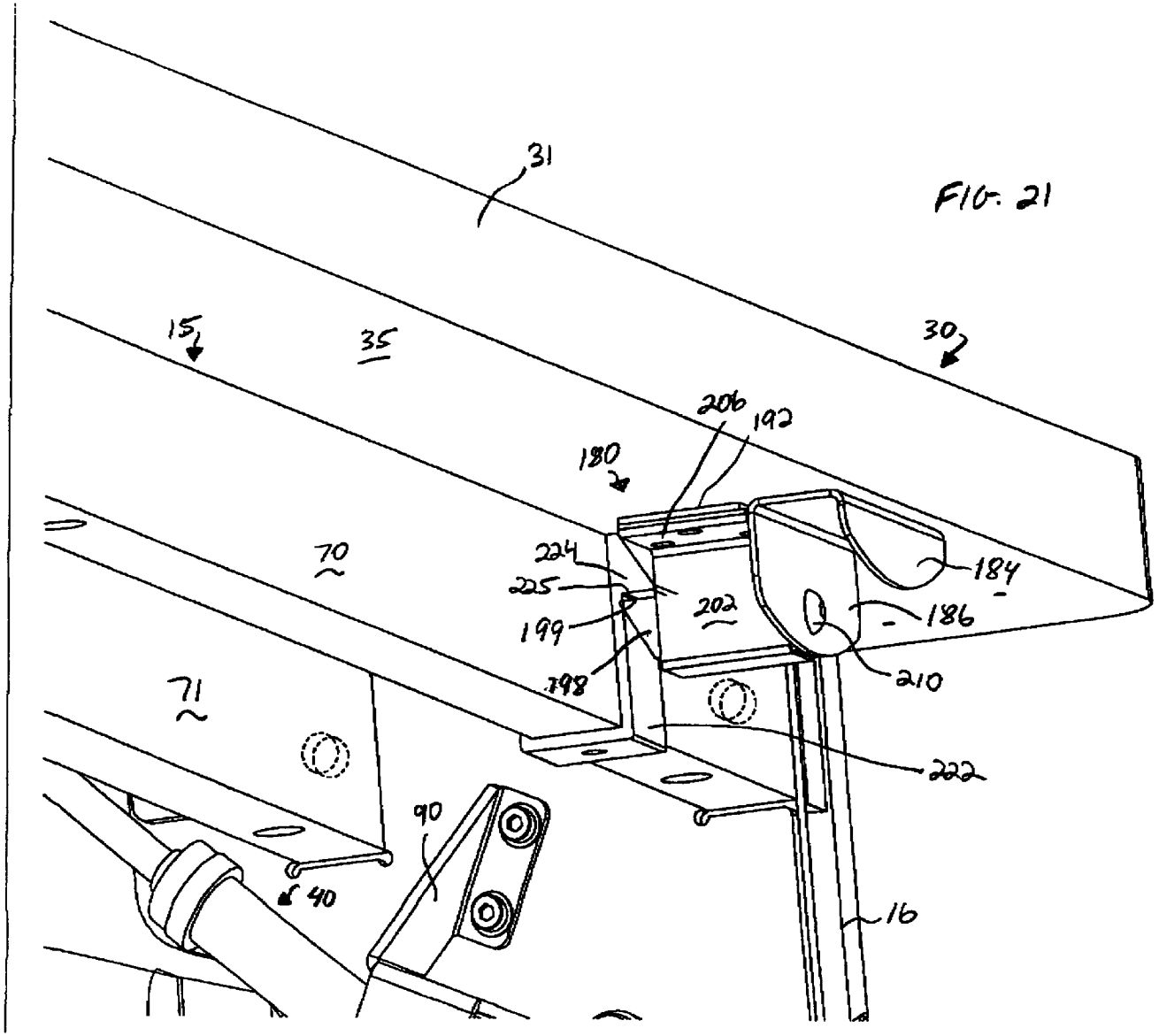
FIG. 21 is an enlarged view of the latch means as shown in FIG. 20.
Figure 22:
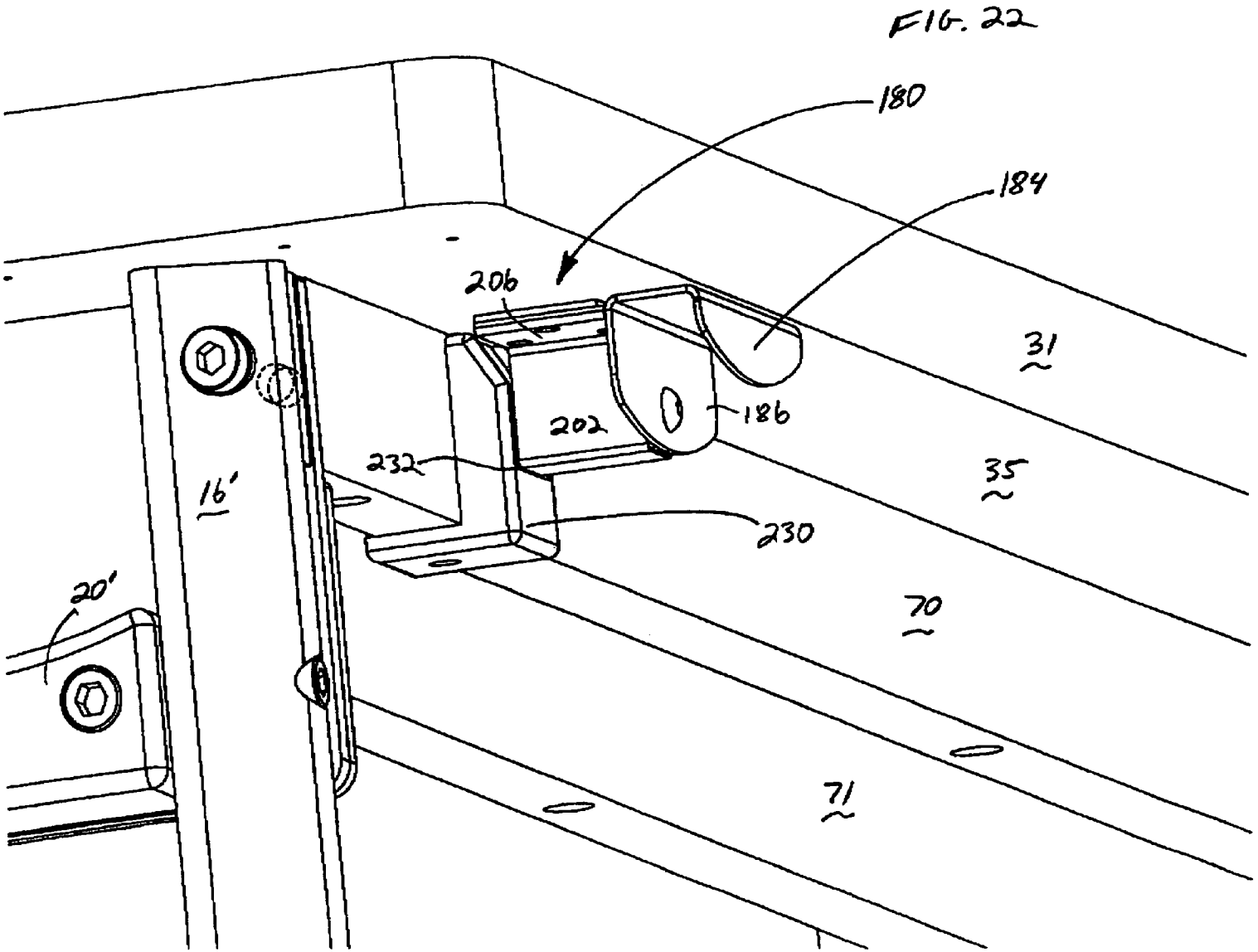
FIG. 22 is a view of the latch means of FIG. 21 and having a novel latch hook cover.

In accordance with this aspect of the invention, this situation is addressed by providing an impact protection means 170 at the top of rear leg members 16, 16' as generally illustrated in FIG. 15. As shown in FIGS. 16–18, impact protection means 170 comprises a top surface 172 from which depend a stopper portion 174 and a shield portion 176. Stopper portion 174 includes a neck 175 that is received in friction-fit engagement within the opening of the tubes that form rear leg members 16, 16'. In the illustrated embodiment, the tubes are triangular in cross-section and the stopper portion 174 is also necessarily triangular in cross-section. The shape of the cross section of rear leg members 16, 16' can be any shape that fits the aesthetic and functional needs of a particular application, and the shape of stopper portion 174 will be selected to match the size and shape of the tube cross-section and to fit within the interior thereof. Shield portion 176 of impact protection means 170 is sized and dimensioned to fit around at least the upper rear surface of leg members 16, 16' and particularly around the upper edges thereof. Shield portion 176 is provided with a plurality of hollowed out pockets 178, that compress slightly upon impact to absorb at least some unwanted forces when the frame of a table contacts the work surface 34 of a rearwardly adjacent table. Impact protection means 170 can be made of any suitable impact resistant plastic material capable of being molded within the tolerances required to achieve proper friction fit within the open tube members of legs 16, 16'.

It may be seen that the impact protection means of the present invention offers three distinct advantages. First, shield portion 176 protects the work surface of a rearwardly adjacent table when stored tables are in nested configuration. Second, within a given table, top surface 172 protects the top of rear leg member 16 and the bottom surface 35 of a table top when the table top is rotated from a storage configuration to a use configuration. Third, the entire impact protection means 170 covers over the opening of a leg member 16 of tubular construction when the table top is in the storage configuration; such a covering is more aesthetically pleasing, and also prevents foreign matter from entering tubular leg 16.

Figure 23B:
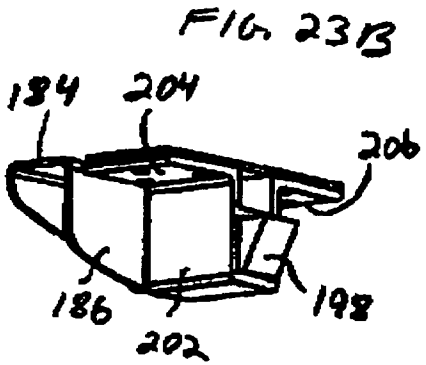
FIG. 23 is an exploded view of a latch assembly suitable for use with the invention.
Figure 23C:
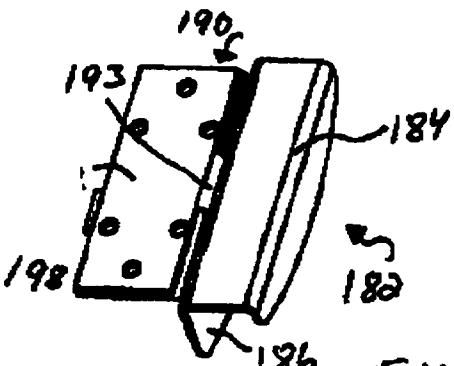
Figure 23A:
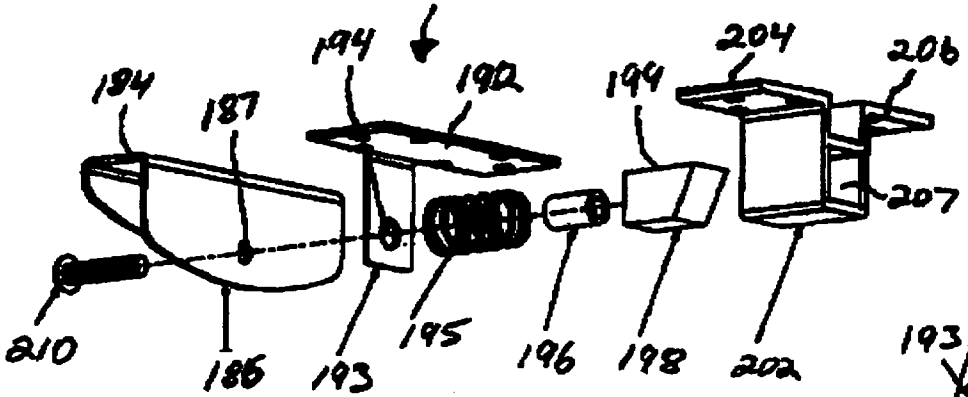
Figure 24B:
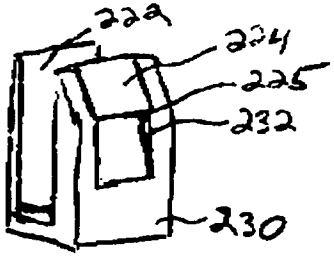
FIG. 24B is a view of the hook assembly of FIG. 24A with a hook cover.
Figure 24A:
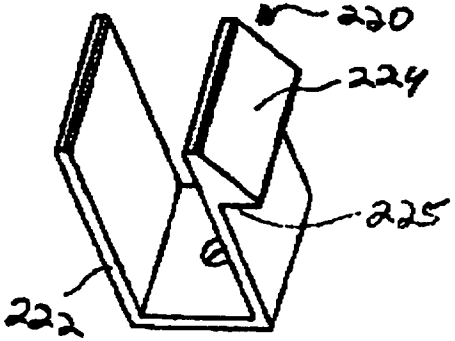
FIG. 24A is a view of the hook assembly of the latch means.

In yet another aspect of the invention, a latch means 180 is provided to releasable secure table top 30 to horizontal support member 15 when the table top is in the use configuration. In one embodiment, illustrated in FIGS. 19–24, latch means 180 comprises latch assembly 182 and hook means 220. Latch assembly 182 comprises a pull handle 184, a spring plate 190, a spring 195, a latch pin 198, and a latch housing 202. Spring plate 190 is fixedly mounted to bottom surface 35 of table top 30 toward rear edge 31, such that spring plate 190 is substantially adjacent to support member 70 when the table top 30 is in the use configuration. Spring plate 190 includes mounting plate 192 for securement to bottom surface 35 of table top 30 and depending tab 193 having a hole 194. Latch housing 202 includes mounting plates 204, 206 that together are of a shape substantially complementary to that of mounting plate 192, such that mounting plates 204, 206 are secured to bottom surface 35 of table top 30 by fastening elements that extend therethrough and also through mounting plate 192, as shown in FIG. 23. Pull handle 184 includes an engagement plate 186 having a hole 187 that is in alignment with hole 194. A screw 210 or other suitable fastening element extends through hole 187 of engagement plate 186, through hole 194 of spring plate 190, through spring 195 and spacer 196, and into engaging contact with latch pin 198, which is slidingly received in tunnel 207 of housing 202. Spring 195 biases latch pin 198 into and through tunnel 207, such that a portion of latch pin 198 extends through the open end of tunnel 207.

Hook means 220 comprises a U-shaped body portion 222 sized and dimensioned to fit around primary horizontal support bar 70, and a hook member 224 having an engagement surface 225. In operation, as shown in FIGS, 20, 21, the upper surface 199 of the portion of latch pin 198 that extends through the tunnel 207 of housing 202 abuts engagement surface 225 of hook means 220, to prevent rotation of table top 30 from the use configuration to the storage configuration. When it is desired to configure the table 10 for storage, the user pulls back on pull handle 184. This urges spring 195 back against depending tab 193 of spring plate 190. The compression of spring 195 causes latch pin 198 to retract into tunnel 207 of latch housing 202, such that upper surface 199 of latch pin 198 is no longer in engaging contact with engagement surface 225 of hook means 220. The table top 30 then can be rotated from the use configuration to the storage configuration.

It will be appreciated that when the user releases the latches to allow the table top to drop into the storage configuration, the user will likely be standing behind rear edge 31 of table top 30. It would not be possible for the user who is doing the unlatching to catch descending front edge 32 of the table top before it drops hard and strikes the front of the front table legs 18, 18'. In tables that do not have the control means of the present invention, two people are preferred to lower the table top, one person standing behind the table to release the latches and one person standing in front of the table to catch and gently lower the front edge 32 to rest against the front of front table legs 18, 18'. Use of a control means 40 as described herein allows the table to be changed from the use configuration to the storage configuration by a single user standing behind the table, because the control means 40 will prevent the tabletop 30 from dropping too quickly and slamming into the front of the frame.

In a preferred embodiment of a latch means 180 for use in a table of the present invention, the hook means 220 can be provided with a cover 230 having a slot 232 that receives both hook member 224 and the extending end of the latch pin 198. The impact protection means 170 described above protects the work surface of the rearwardly adjacent table when the tables are stored in nesting relationship. Yet if the tables were to contact one another at an angle, rather than in the ideal nesting relationship shown in FIG. 15, then the rearwardly facing hook member 224 on horizontal support member 70 of one table could damage or scratch the top surface 34 of the next adjacent table. Hook cover 230 prevents the corners of hook member 224 from striking the top surfaces 34 of the next adjacent nested table, to protect both the hook member 224 and the table surface from breaking or scratching.

Figure 26:
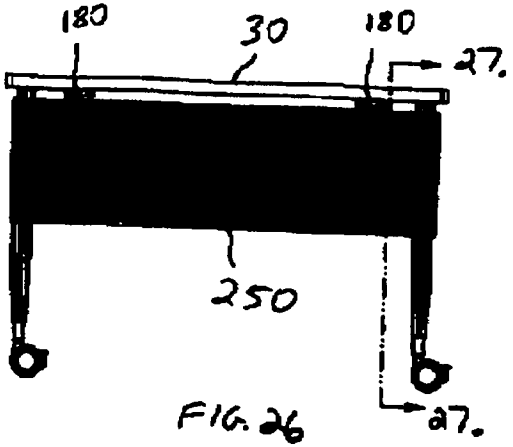
FIG. 26 is a rear elevation view of the embodiment illustrated in FIG. 25.
Figure 25:
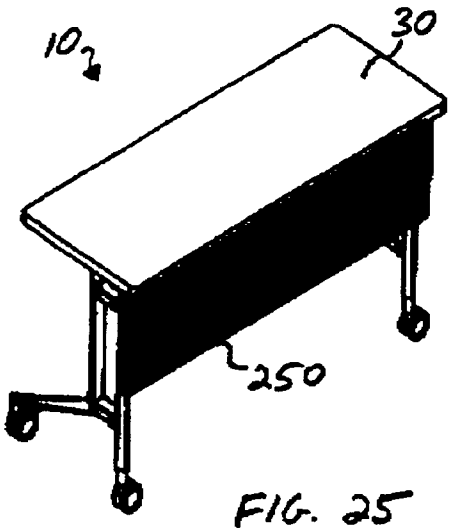
FIG. 25 is a is a rear perspective view of an alternative embodiment of the invention in which a modesty screen is provide across the back of the frame.
Figure 27:
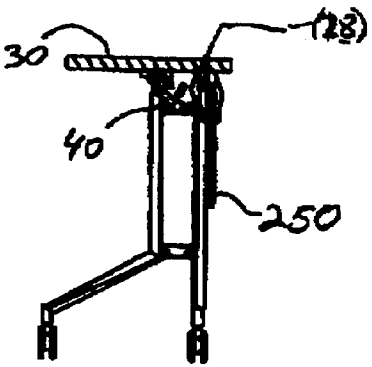
FIG. 27 is a cross-sectional view taken through line 27—27 of FIG. 26.

FIGS. 25–32 illustrate yet another embodiment of the invention. As illustrated in FIGS. 25 and 26, table 10 includes a panel 250 on the rear of frame 12. Depending on the arrangement of such tables 10 in a room during use, such panels 250 can help provide modesty for certain users, thereby improving those users' comfort level while working at the table. Such panels are known in the art as "modesty panels." It is a challenge, however, to provide a modesty panel on a nesting table with a rotating table top, in such a way that the panel will neither interfere with the rotational movement of the table top or the rotational control means, nor itself become damaged or broken when a table top is moved from the use to the storage configuration, or vice versa. Further, such a panel must not interfere with the nesting relationship of the tables.

Figure 29:
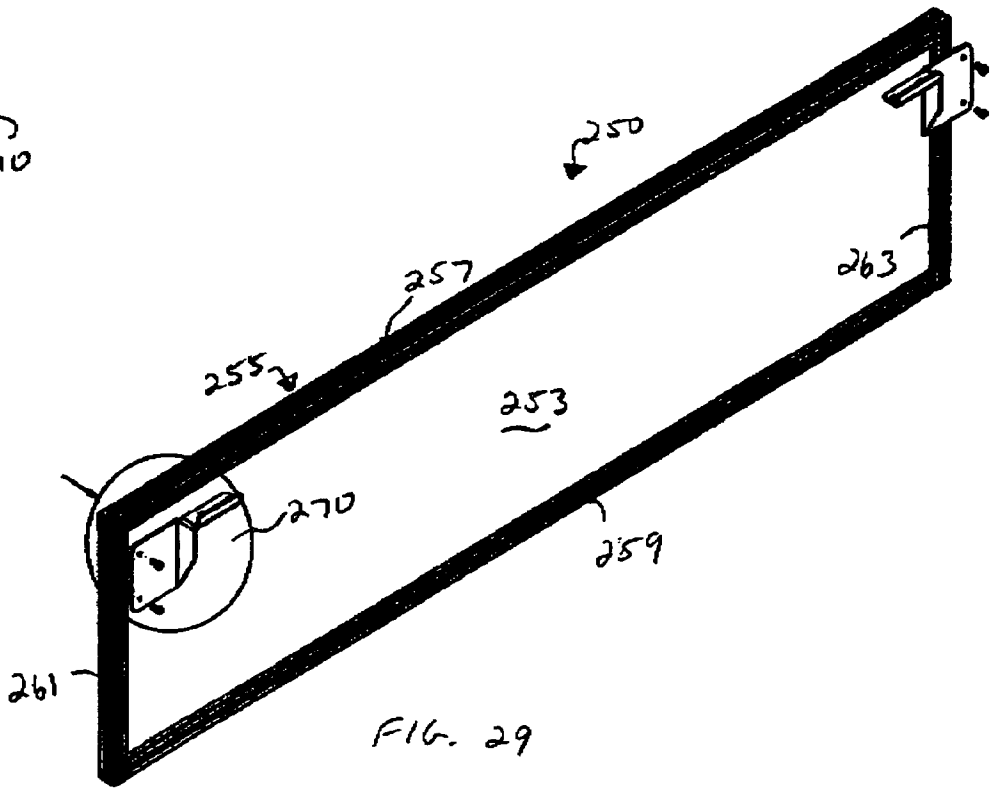
FIG. 29 is an unassembled view of the modesty screen with mounting brackets in accordance with the present invention.
Figure 30:
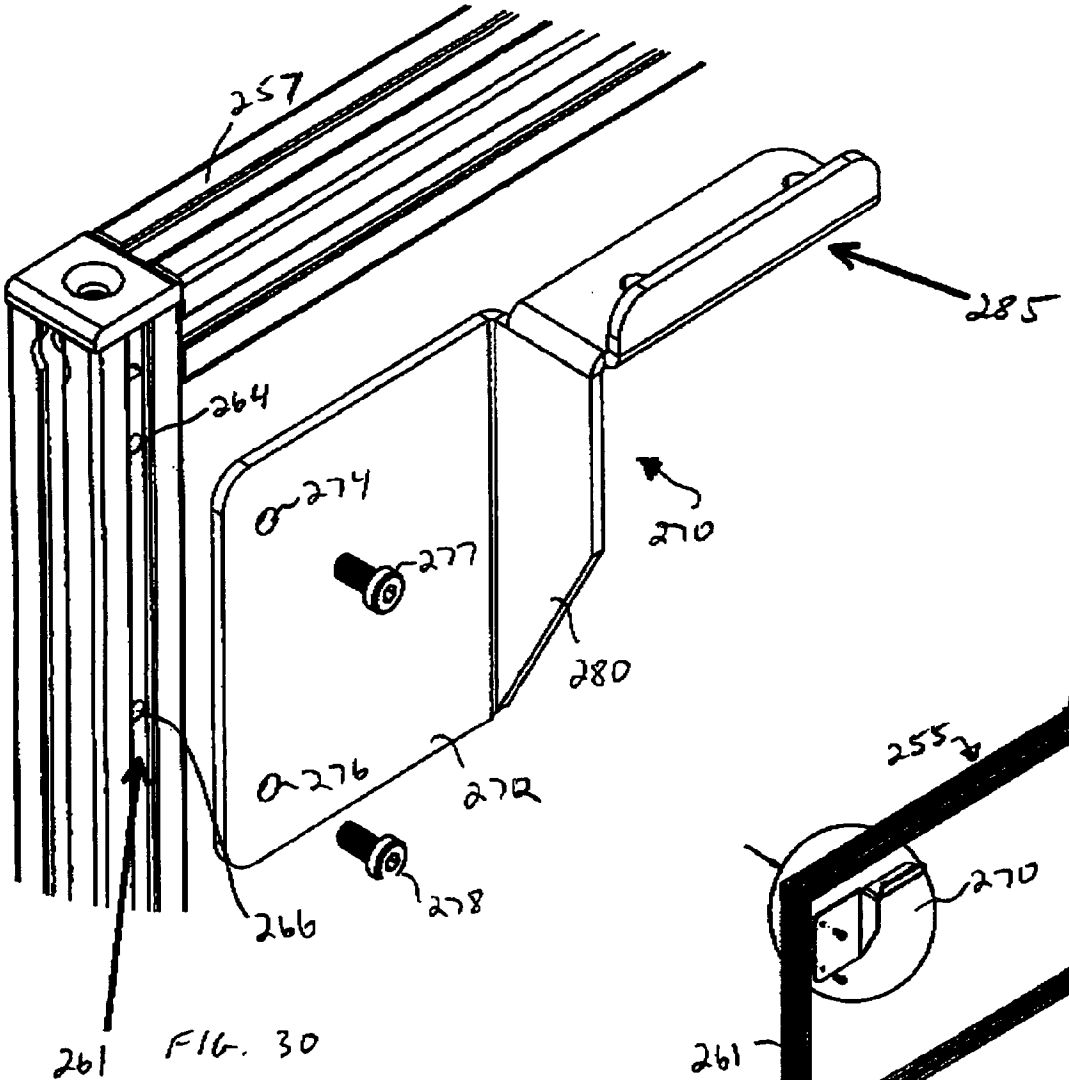
FIG. 30 is an enlarged view of one portion of FIG. 29.

FIGS. 29–30 illustrate a panel of the type known in the art, and a mounting bracket developed by the inventors herein so that such a panel 250 can be used with the nesting tables of the present invention. As illustrated, panel 250 comprises a central portion 253 which can be made of a lightweight material that can be substantially opaque, such as certain fabrics. Center portion 253 is supported about its perimeter by a frame 255. In the illustrated embodiment, frame 255 surrounds the entire perimeter of the panel 250, although it need not do so in all embodiments. Frame 255 may include upper horizontal member 257, lower horizontal member 259, and side members 261, 263. As seen more clearly in FIG. 30, frame 255, can be made of a sturdy, lightweight material, such as extruded aluminum.

Figure 28:
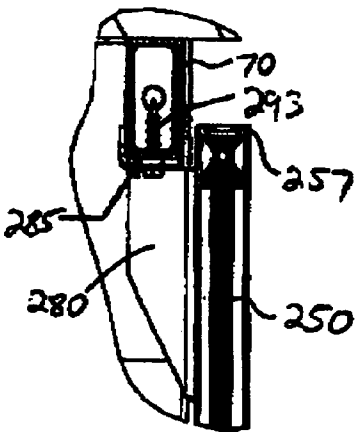
FIG. 28 is an enlarged view of a portion of FIG. 27.
Figure 32:
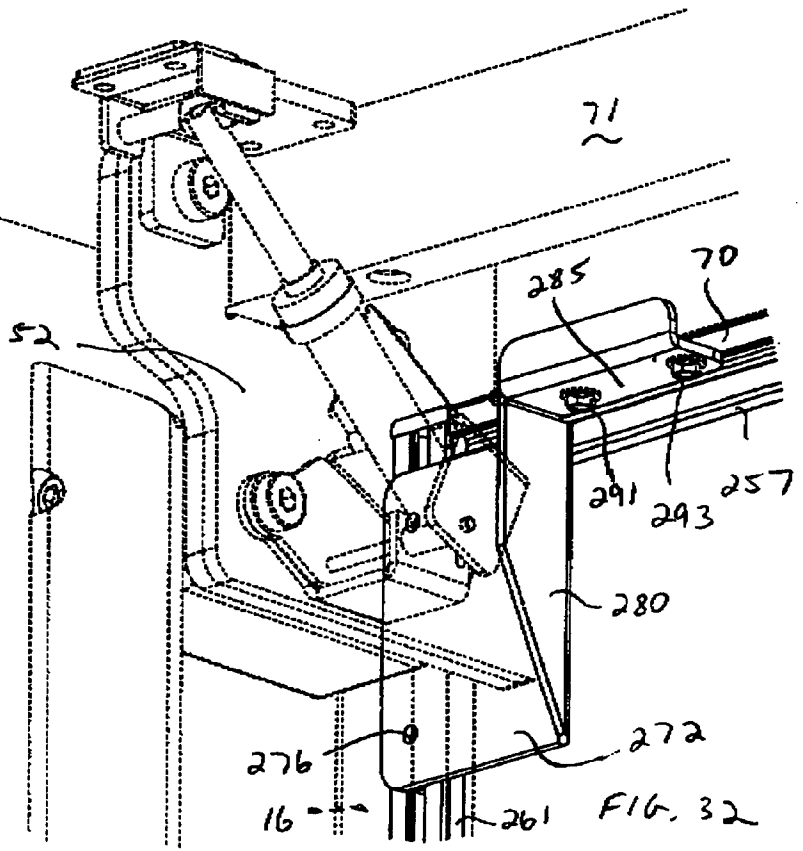
FIG. 32 shows the assembly of FIG. 31 mounted in a table of the present invention, the table and it related control means and mounting means being shown in phantom lines.
Figure 31:
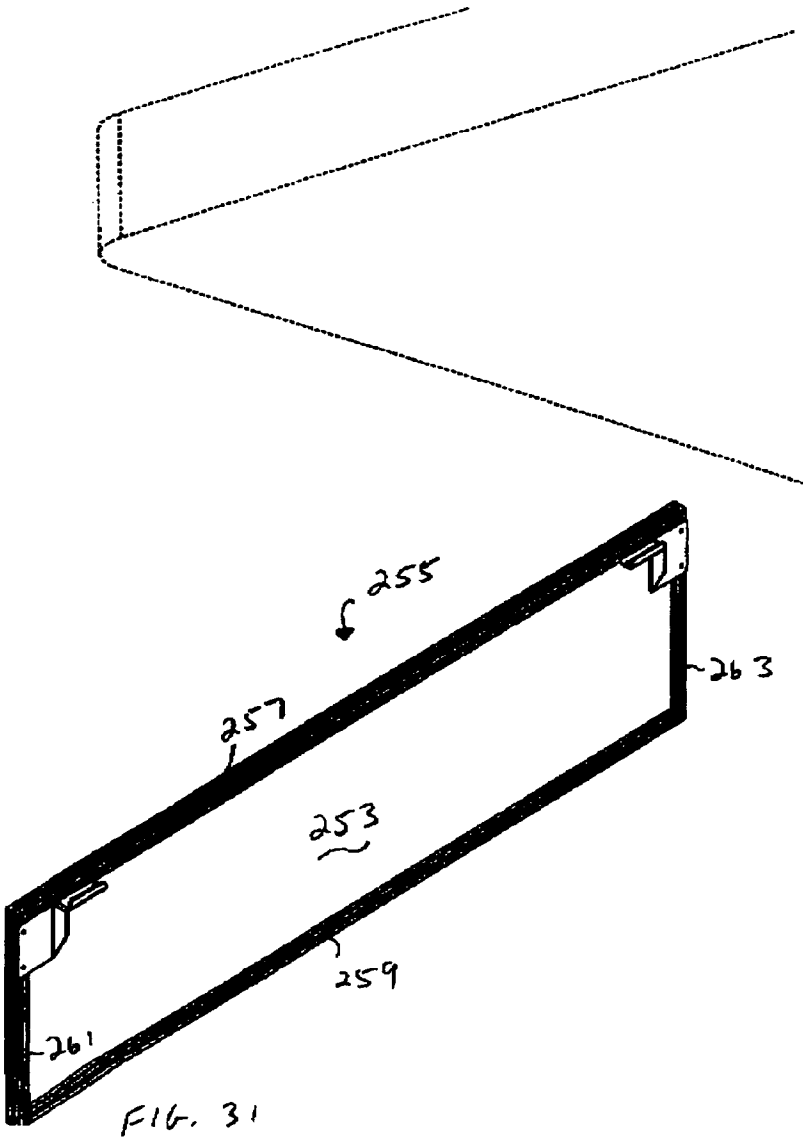
FIG. 31 is an assembled view of FIG. 29.

In accordance with the invention, a panel mounting bracket 270 comprises a lateral mounting plate 272 which is mounted to side member 261 of frame 255 by holes 274, 276 therein that are aligned with holes 264, 266 in side member 261 by known fastening means such as bolts 277, 278. Lateral mounting plate 272 is connected by gusset 280 to upper mounting plate 285. Upper mounting plate 285 is parallel to horizontal support bar 70 of frame 12 of table 10, and includes holes 287, 289 by which upper mounting plate 285 can be fastened to horizontal support bar 70 by fastening means such as bolts 291, 293, as shown in FIGS. 28 and 32. As seen most clearly in FIG. 26, the design of panel mounting bracket 270 allows panel 250 to be mounted at a height on the table frame sufficient to provide the desired modesty for a user, yet low enough on the frame so that it does not interfere with user access to or operation of latch means 180, as discussed above.

While the present invention has been described in terms of a preferred embodiment, it will be understood that this embodiment is presented for purposes of illustration and not by way of limitation. Other embodiments, including known equivalents of some of the means described herein, will be known to those skilled in the art, and are intended to be encompassed within the scope of the claims hereto.

What is claimed is:

1. A nesting table comprising:

a frame, a table top pivotably mounted to said frame, said table top being able to pivot between a use configuration that is horizontal relative to the frame and a storage configuration that is vertical relative to the frame, and a control means that controls the rate of pivoting of the table top from the use configuration to the storage configuration but does not affect the rate of the rotation of the table top from the storage configuration to the use configuration.

2. The nesting table of claim 1 wherein said control means is mounted to said frame.

3. The nesting table of claim 1 wherein said frame comprises a horizontal support member, and at least two vertical support members, each vertical support member having a first foot and a second foot.

4. The nesting table of claim 3 wherein each said second foot is on an angled extension member extending from said vertical support member, such that when said table is in the storage configuration, one said frame can nest with another said frame.

5. The nesting table of claim 1 wherein said control means is selected from the group consisting of a spring, a piston, and a damper.

6. The nesting table of claim 5 wherein said control means is a surface effect damper.

7. The nesting table of claim 1 further comprising a latch means for releasably securing said table top in said use configuration.

8. The nesting table of claim 7 wherein said latch means comprises a latch assembly and a hook assembly, said latch assembly releasably engaging said hook assembly to prevent unwanted rotation of said table top from said use configuration to said storage configuration.

9. In a nesting table comprising a frame and a table top pivotably mounted to said frame, said table top being pivotable between a use configuration that is horizontal relative to said frame and a storage configuration that is vertical with respect to said frame, the improvement comprising a means for controlling the rate of pivoting of the table top from the use configuration to the storage configuration but not affecting the rate of the rotation of the table top from the storage configuration to the use configuration.

10. The nesting table of claim 9 wherein said means for controlling the rate of pivoting of the table top comprises a damper.

11. The nesting table of claim 10 wherein said damper is a surface effect damper.

12. A nesting table comprising a frame, a table top pivotably mounted to said frame, said table top being able to pivot between a use configuration that is horizontal relative to said frame and a storage configuration that is vertical relative to said frame, and a control means that controls the rate of pivoting of the table top from the use configuration to the storage configuration, said nesting table further comprising a latch means for releasably securing said table top in said use configuration, said latch means comprising a latch assembly and a hook assembly, said latch assembly releasably engaging said hook assembly to prevent unwanted rotation of said table top from said use configuration to said storage configuration, said nesting table further comprising a cover for said hook, which cover allows said latch assembly to engage said hook assembly, while protecting adjacent tables in storage configuration from damage by inadvertent contact with said hook assembly.

13. A nesting table comprising a frame, said frame comprising at least one vertical support member, a table top pivotably mounted to said frame, said table top being able to pivot between a use configuration that is horizontal relative to the frame and a storage configuration that is vertical relative to the frame, and a control means that controls the rate of pivoting of the table top from the use configuration to the storage configuration, wherein at least a portion of said vertical support member is of tubular construction, said table further comprising an impact protection means adapted to fit within an open end of said tubular construction, such that said impact protection means prevents damage to an adjacent table that comes into inadvertent contact with said open tubular end.

14. The nesting table of claim 13 wherein said impact protection means comprises a stopper portion that fits within said open tubular construction and a shield portion that overlays at least a portion of the edge of said open tubular construction.

15. A nesting table comprising a frame comprising a vertical support member, and a table top pivotably mounted to said frame, said table top being able to pivot between a use configuration that is horizontal relative to the frame and a storage configuration that is vertical relative to the frame, and a panel mounted to said vertical support member for the modesty of the user, such that said panel does not interfere with the pivoting motion of said table top between the use configuration and the storage configuration, and a control means that controls the rate of the rotation of the table top from the use configuration to the storage configuration but does not affect the rate of the rotation of the table top from the storage configuration to the use configuration.

16. The nesting table of claim 15 wherein said control means is a surface effect damper.

* * * * *